US005139142A

United States Patent [19]

Simon

[11] Patent Number: 5,139,142

[45] Date of Patent: Aug. 18, 1992

[54] DISPOSABLE TOOTHBRUSH COVER

[75] Inventor: Eric M. Simon, Salt Lake City, Utah

[73] Assignee: Dexterity, Inc., Salt Lake City, Utah

[21] Appl. No.: 625,953

[22] Filed: Dec. 11, 1990

[51] Int. Cl.[5] ..... B65D 83/10

[52] U.S. Cl. ..... 206/362.3; 206/361; 206/362.4; 206/368; 206/63.5

[58] Field of Search ..... 206/361, 362, 362.1-362.4, 206/15.2, 15.3, 368, 63.5

[56] References Cited

U.S. PATENT DOCUMENTS

| | | | |
|---|---|---|---|
| 741,321 | 7/1903 | Flower | 206/362.3 |
| 1,041,315 | 4/1912 | Marx | 206/362.3 |
| 1,179,800 | 4/1916 | Carswell | 206/362.2 |
| 1,653,540 | 12/1927 | Bigoney | 206/362.3 |
| 1,827,654 | 9/1931 | Harper | 206/362 |
| 2,144,755 | 2/1939 | Freedman | 24/587 |
| 2,353,517 | 7/1944 | Spanel et al. | 206/15.1 |
| 2,655,968 | 8/1953 | Simmons | 15/247 |
| 2,794,228 | 6/1957 | Teher | 24/576 |
| 2,947,412 | 8/1960 | Tupper | 206/15.1 |
| 3,120,019 | 4/1964 | Scott | 15/184 |
| 3,198,228 | 9/1965 | Naito | 383/65 |
| 3,420,433 | 3/1969 | Bostwick | 229/80 |
| 3,633,642 | 1/1972 | Siegel | 383/64 |
| 3,746,162 | 11/1973 | Bridges | 206/361 |
| 3,942,713 | 10/1976 | Olson et al. | 383/62 |
| 4,384,382 | 4/1983 | Diamant | 15/104 R |
| 4,570,652 | 8/1986 | Chavez | 132/310 |
| 4,658,433 | 11/1987 | Savicki | 383/63 |
| 4,660,259 | 9/1987 | Ausnit | 24/587 |
| 4,835,813 | 5/1989 | Lorenzawa et al. | 15/184 |
| 4,880,020 | 9/1989 | Schurgin | 132/308 |
| 4,880,111 | 11/1989 | Bagwell et al. | 206/209.1 |

OTHER PUBLICATIONS

Cobb, C. M., The Tooth Brush As A Cause of Repeated Infections of the Mouth. Boston Med. Surg. J. 183 (1920) 263-264.

Glass, R. T. and H. G. Jensen, More On the Contaminated Toothbrush: The Viral Story. Quintessence Int'l 19 (1988) 713-716.

Hingst, V., [The Importance of Contaminated Dental Care Commodities-Results of Field Research]. Zbl. Bakt. Hyg. B 187 (1989) 337-364. [German Text with English Abstract].

*Primary Examiner*—Paul T. Sewell
*Assistant Examiner*—Thomas P. Hilliard

[57] ABSTRACT

A protective cover for the bristle portion (10) of a toothbrush (12) is adapted for disposability and reduced bulkiness. The cover is composed of two pieces of flexible, waterproof material (14, 14') which have been bonded along the top edge (16) and lateral edges (18, 20) to form a pouch-like container. The remaining lateral edges (26, 26') are supplied with rib-and-groove closure profiles (32, 34) to provide for ease of insertion and resealability. The bottom edges (22, 22') are unbonded to allow the toothbrush handle (24) to project externally. Alternately, an adhesive strip closure (72) may be used in place of rib-and-groove closure profiles (32, 34). The toothbrush cover may be produced rapidly and inexpensively to allow for disposal after a usage period of up to ten days, thereby reducing the probability of microbial colonization.

2 Claims, 7 Drawing Sheets

DISPOSABLE TOOTHBRUSH COVER

FIELD OF INVENTION

This invention relates to toothbrush covers, more specifically to toothbrush covers which enclose the bristle portion of a toothbrush and are adapted for disposability and compactness.

BACKGROUND OF THE INVENTION—DESCRIPTION OF PRIOR ART

When required to use a toothbrush in a location remote from the home, such as in the case of travelling, the issue of packaging the toothbrush for transport and storage commonly arises. Covers for toothbrushes are known and often comprise an elongated container in which the toothbrush is placed. Chavez, in U.S. Pat. No. 4,570,652 (1986), discloses this type of toothbrush container. A general disadvantage of toothbrush containers which completely enclose the toothbrush is their relative bulkiness.

To reduce the problem of bulkiness, another toothbrush container takes the form of a small rectangular receptacle or cover which is placed over the bristle portion of the toothbrush, allowing the handle of the toothbrush to project externally. Examples of this type of container can be found in U.S. Pat. No. 4,835,813 to Lorenzana et al. (1989); 4,880,020 to Schurgin (1989); 3,746,162 to Bridges (1973); 3,120,019 to Scott (1964); 2,655,968 to Simmons (1953); 1,041,315 to Marx (1912); and 741,321 to Flower (1903). Although less bulky than elongated toothbrush containers, these toothbrush containers are all substantially three dimensional and therefore require more than minimal space. Additionally, most of these toothbrush containers employ nonintegral hinging and fastening means for closure which increases both their complexity and the associated manufacturing costs.

In U.S. Pat. No. 1,827,654 (1931), Harper describes a toothbrush cover comprising a rectangular sheet of flexible, waterproof material adapted to be folded about the bristle portion of a toothbrush in which a slit adjacent to one corner of the material has been made, thereby allowing the handle portion to project externally. This toothbrush cover, however, utilizes additional snap-fasteners, is not adapted for disposability, and requires a moderate amount of dextrous manipulation for closure.

A general concern with the aforementioned containers is associated with hygiene. Although such containers can be regularly washed and sanitized after use, their users commonly do not do so. This can give rise to bacterial and viral colonization and the subsequent possibility of oral infection. A causal relation between toothbrush contamination and oral infection was discussed by Cobb on pp. 263–264 of vol. 183 of the Boston Medical and Surgical Journal (1912). More recently, Hingst in Zentralblatt fur Bakteriologie, Mikrobiologie und Hygiene B, pp. 337–364, vol. 187 (1989) presented data indicating that toothbrushes should in practice be disposed of at three month intervals and after all cases of oral inflammation. Additionally, Glass and Jensen, on pp. 713–716 of vol. 19 of Quintessence International (1988) report finding viable herpes simplex virus on toothbrushes seven days after use and have therefore recommended changing toothbrushes every two weeks for healthy individuals.

Although current U.S. patent literature does not disclose a disposable toothbrush cover intended for storage and transport purposes, Diamant in U.S. Pat. No. 4,384,382 (1983) shows a disposable toothbrush cover intended to be placed over the brush portion of a toothbrush to reduce mechanical agitation to the teeth and gums during brushing, in addition to reducing the risk of pathogenic infection. This disposable toothbrush cover emphasizes the use of a nonconventional toothbrush handle and is not adapted for transport and storage.

In summary, the toothbrush covers heretofore known suffer from a number of disadvantages:

(a) They are intended for durable use and as such can harbor infectious pathogens which can be transferred to the user's toothbrush and subsequently to the user's mouth.

(b) They are of a substantially tubular or box-like geometry which often takes unnecessary space.

(c) Their three-dimensional geometry, coupled with the fact that many are formed from polyolefinic materials, makes them difficult to print on.

(d) Their three-dimensional geometry and/or the need for nonintegral fastening structures do not facilitate large volume, high speed production and concurrent cost reduction.

OBJECTS AND ADVANTAGES

Accordingly, several objects and advantages of the present invention are:

(a) to provide an improved disposable toothbrush cover, (b) to provide such a cover, which, by nature of its disposability, reduces the potential for microbial colonization and transfer to the toothbrush which it contains or to other objects which it may come in contact with;

(c) to provide a disposable toothbrush cover for which the cost of materials and method of manufacture are so minimized as to allow the cover to be sold competitively against existing durable-use toothbrush covers;

(d) to provide a disposable toothbrush cover designed so as to reduce bacterial and viral colonization;

(e) to provide a disposable toothbrush cover which requires minimal space while being utilized;

(f) to provide a disposable toothbrush cover which requires minimal space prior to utilization, thereby lending itself to compact, multiple unit packaging and economy of transport;

(g) to provide a disposable toothbrush cover which employs a resealable closure of a nature to allow moderate but not necessarily extended use since the cover is intended to be utilized for a period of up to ten days and then disposed of;

(h) to provide a disposable toothbrush cover which is simple to use, requiring a minimum of instruction and/or dextrous manipulation;

(i) to provide a disposable toothbrush cover which will present a suitable surface for the reception of labeling or print.

(j) to provide a disposable toothbrush cover which, by nature of its construction from continuous plastic tube-stock, provides a medium for high speed production, including printing, sealing, cutting, and packaging.

Further objects and advantages will become apparent from a consideration of the ensuing description and accompanying drawings.

REFERENCE NUMERALS IN THE DRAWINGS

| | |
|---|---|
| 10 bristle portion | 12 toothbrush |
| 14, 14' plastic sheets | 16 top edge |
| 18 diagonal lateral edge | 20 lateral edge |
| 22, 22' bottom edges | 24 handle portion |
| 26, 26' lateral edges | 28, 28' opening tabs |
| 30, 30' circular fillets | 32 rib closure profile |
| 34 groove closure profile | 36 rib-and-groove bond point |
| 38 rib bottom point | 38' groove bottom point |
| 40, 40', 42, 42', 44, 44' circular ventilation holes | |
| 46, 46' prolate ventilation holes | 48, 50, 52 bent-circular ventilation holes |
| 54, 56 lateral edges | 58 curved lateral edge |
| 60 lateral edge | 62 semi-circular edge |
| 64 lateral edge | 66, 68 end seal points |
| 70, 70' opening webs | 72 adhesive strip |

DETAILED DESCRIPTION OF THE INVENTION—FIGS. 1 AND 2

Figure 1:
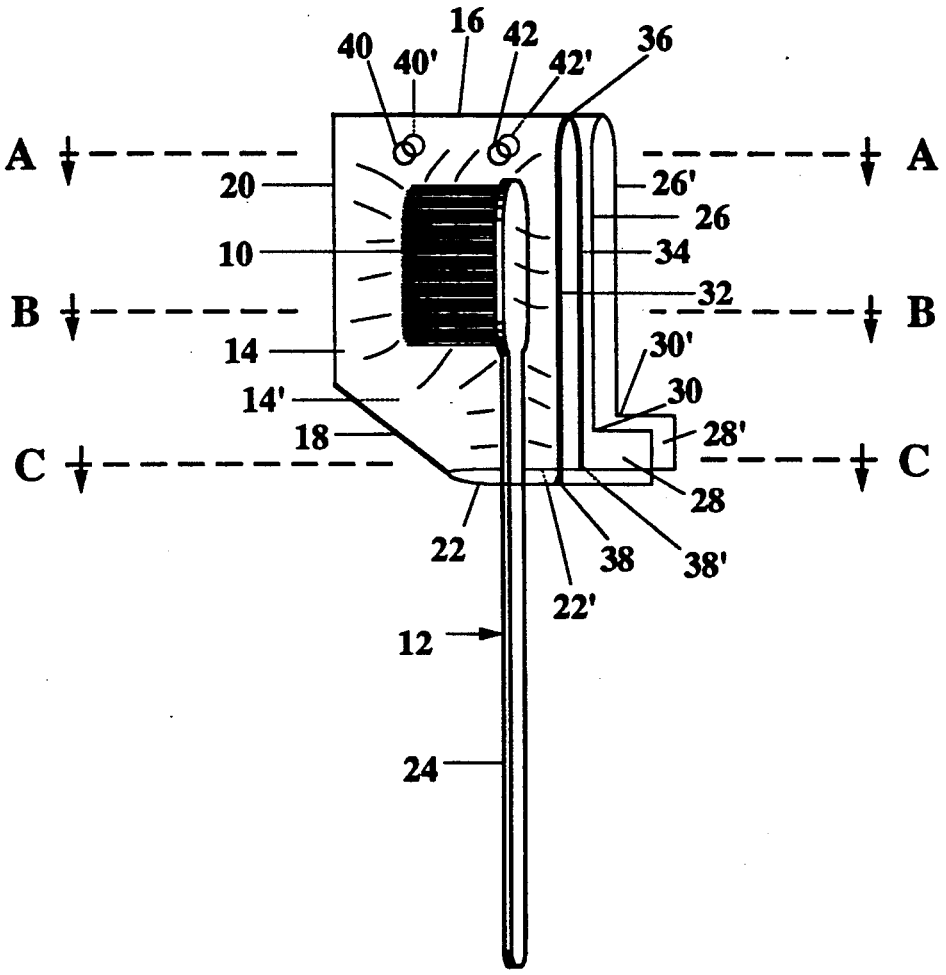
FIG. 1 is a side perspective view of a preferred embodiment of a disposable toothbrush cover with the toothbrush completely inserted and a resealable closure unengaged.

FIG. 1 shows a preferred embodiment of the disposable toothbrush cover as it is positioned covering bristle portion 10 of a toothbrush 12. The cover is composed of two pieces of flexible plastic sheet, 14 and 14', positioned and sealed in a side-by-side manner (shown front and rear in FIG. 1) to produce a pouch-like container. Sheets 14 and 14' may be composed of various flexible thermoplastic materials, preferably polyethylene or polypropylene, and most preferably low density polyethylene. Furthermore, sheets 14 and 14' may range from 0.010 mm to 0.250 mm in thickness, more preferably from 0.030 mm to 0.100 mm, and most preferably 0.0050 mm.

Sheets 14 and 14' are sealed along top edge 16 and diagonal lateral edge 18 using a cut-and-seal or similar method as is known to those familiar with the art. Lateral edge 20 may similarly be formed by a cut-and-seal operation or may simply consist of a fold between continuous sheets 14 and 14'. The cover has bottom edges 22 and 22' which are unsealed to allow handle portion 24 of toothbrush 12 to project externally to the outside of the cover.

Bottom edges 22 and 22' are formed simultaneously by a die-cut or similar method as is known to those familar with the art. Similarly, lateral edges 26 and 26' are likewise formed simultaneously by a die-cut or similar method, having integral opening tabs 28 and 28'. The tabs are substantially semi-circular and are located at the open end of the cover, being continuous with bottom edges 22 and 22'. The opening tabs are preferably connected to lateral edges 26 and 26' by circular fillets 30 and 30' to reduce the potential for tearing when opening the cover.

Situated inward and running parallel to lateral edges 26 and 26' is a rib-and-groove closure 32 and 34. Rib 32 is positioned on sheet 14 and groove 34 is positioned on sheet 14', although this may be reversed. The production and use of rib-and-groove closures, also commonly known as zipper-locking fasteners, for containers produced from plastic sheet is well known in the art. Such closures are generally composed of two complementary strips or profiles of a flexible plastic material, such as polyethylene. These profiles are generally produced by melt extrusion in a manner to impart a locking geometry when the two strips are brought into intimate contact, such contact being imparted through sliding finger pressure. These profiles may essentially be that of two symmetric and opposing hook elements such as described by U.S. Pat. No. 4,660,259 to Ausnit (1987), 3,633,642 to Siegel (1972), and 2,794,228 to Teher (1957). Alternately, the closure profiles may be asymmetric and composed of an opposing rib and the groove set. U.S. Pat. No. 4,658,433 to Savicki (1987), 3,198,228 to Naito (1965), 2,144,755 to Freedman (1939) describe this type of rib-and-groove closure. The rib-and-groove closure of FIG. 1 may be formed simultaneously with sheets 14 and 14' by melt extrusion of the thermoplastic material or may be formed and subsequently bonded to the surface of the sheets.

Rib 32 and groove 34 are bonded together at point 36 along top edge 16 in the same cut and seal operation in which top edge 16 is formed. Point 36 may or may not be subsequently reinforced by an additional thermal sealing operation to reduce the potential for tearing upon opening the cover or when depositing or removing the toothbrush 12. Conversely, rib 32 and groove 34 are left unbonded at points 38 and 38' along bottom edges 22 and 22', respectively. This is to allow the bristle portion 10 of toothbrush 12 to be easily deposited or removed from the cover (described in Operations section, infra).

Located adjacent to top edge 16 and through sheets 14 and 14' are ventilation holes 40, 40', 42, and 42'. Ventilation holes 40 and 40' are formed simultaneously in a die-cut or similar operation such as known to those familiar with the art, as are ducts 42 and 42'. The holes are formed to allow adequate aeration of the bristle portion 10 of toothbrush 12 after use to reduce the possibility of microbial colonization of the cover. Moreover, the ducts are positioned away from the central area of sheets 14 and 14' to avoid possibility of engaging the bristle portion 10 as it is being inserted in the cover, thereby preventing the bristles from projecting externally in an undesired fashion. The ventilation ducts may be of any polygonal geometry, most preferably circular to reduce the potential for tearing, having a diameter between 1.25 mm and 6.50 mm, more preferably between 2.50 mm and 4.00 mm, and most preferably 3.00 mm.

Figure 2A:
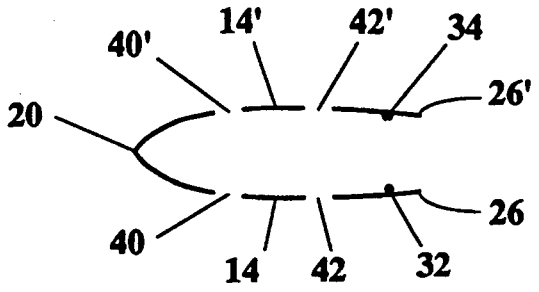
FIGS. 2A, 2B, and 2C are sectional views taken on lines A—A', B—B', C—C', respectively, of FIG. 1.
Figure 2B:
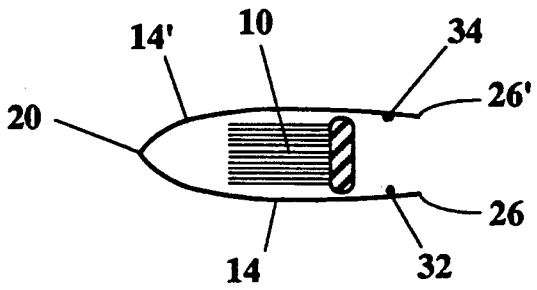
Figure 2C:
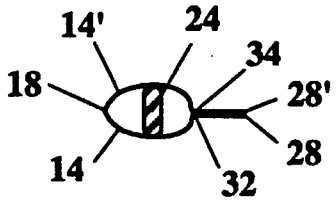

FIGS. 2A, 2B, and 2C are cross-sectional views taken in the directions indicated by lines A—A', B—B' and C—C', respectively, of FIG. 1. FIG. 2A shows a view through the top section of the cover along the plane consisting of the center points of ventilation ducts 40, 40', 42, and 42'. FIG. 2B is through the middle section of the cover, intersecting the bristle portion 10 of the toothbrush. The bottom section of the cover is transected in FIG. 2C showing the handle portion 24 of the toothbrush and opening tabs 28 and 28'. FIGS. 2A and 2B both depict the cover in an open position. FIG. 2C shows the cover to be closed with rib-and-groove closure profiles 32 and 34 fully engaged.

Figure 7:
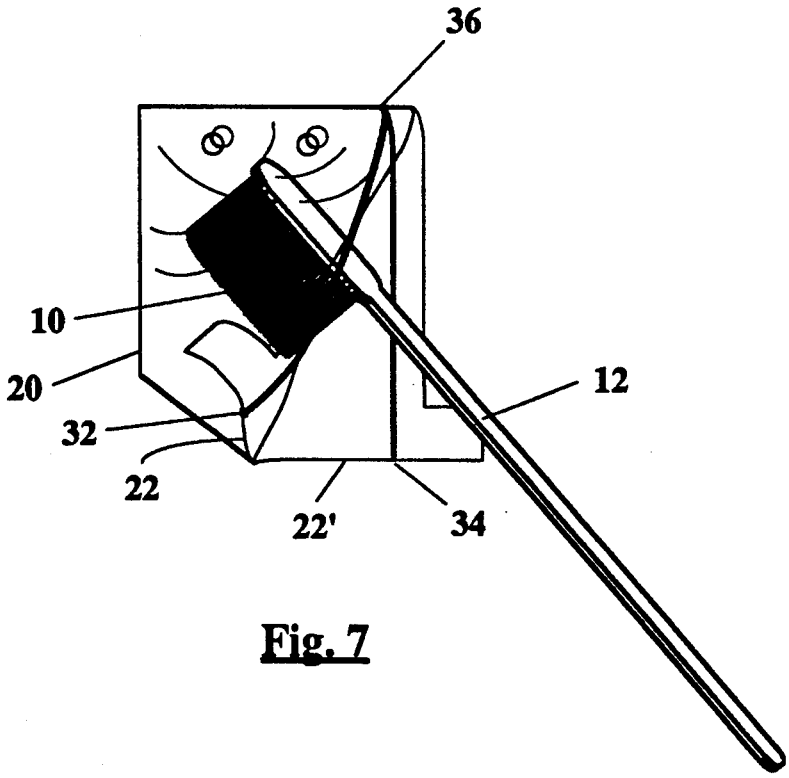
FIG. 7 is a side perspective view of the preferred embodiment of the cover with a toothbrush partially inserted.
Figure 8:
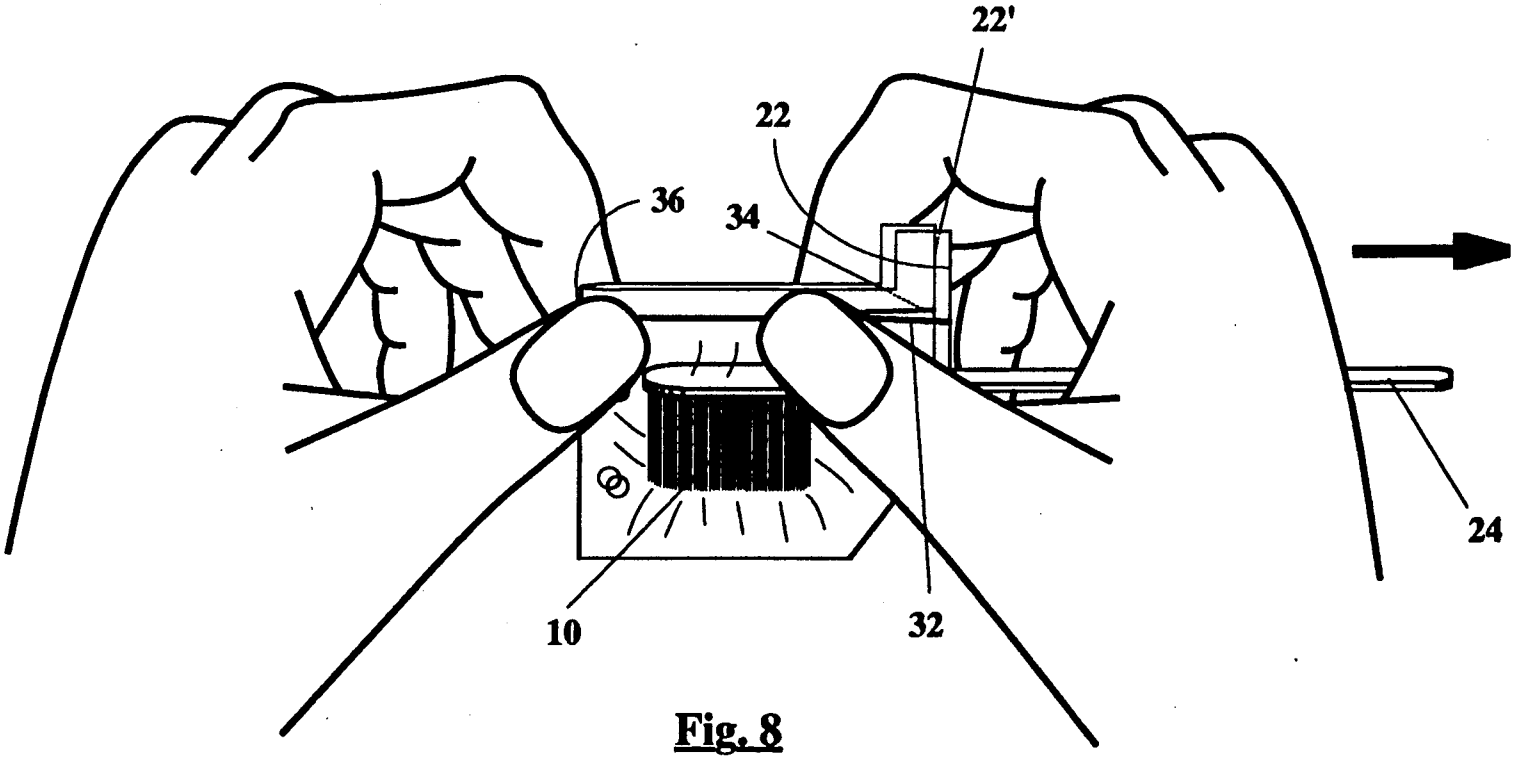
FIG. 8 is a side view showing the manipulation of the pouch.

OPERATION—FIGS. 1, 7, and 8

Prior to depositing the toothbrush, the disposable toothbrush cover is opened by grasping opening tabs 28 and 28' in each hand and simultaneously pulling each in a direction away from the other such that rib-and-groove closure 32-34 is disengaged at ends 38 and 38'. The tabs are persistently pulled until the closure is disengaged to the maximum extent, stopping at sealed point 36 along top edge 16. Bristle portion 10 of the toothbrush 12 is inserted into the open cover such that the bristles are directed toward lateral edge 20 as shown in FIG. 7.

Once the toothbrush has been completely inserted into the cover, as shown in FIG. 1, the cover is sealed by gripping the end of the rib-and-groove closure at sealed point 36 with one hand and sliding one's fingers along the closure with the other hand in a direction toward bottom edges 22 and 22' as shown in FIG. 8. Sliding finger pressure is applied until rib-and-groove closure 32-34 is completely reengaged.

DETAILED DESCRIPTION OF THE INVENTION—FIGS. 3A-D, 4A-D, 5A-C, and 6

Figure 3A:
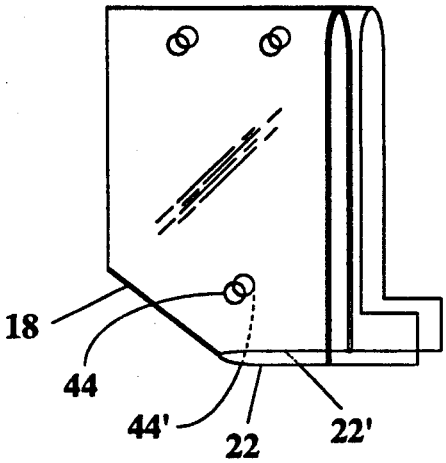
FIGS. 3A, 3B, 3C, and 3D are side perspective views of alternative embodiments of disposable toothbrush covers which employ different arrangements of ventilation ducts but have the same outline geometry.
Figure 3B:
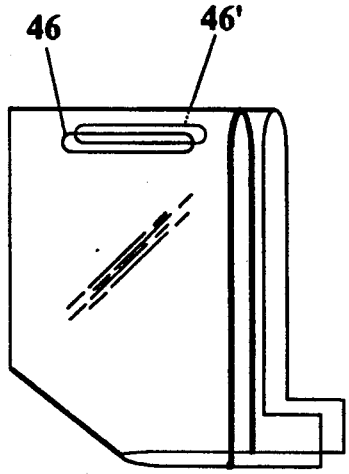
Figure 3C:
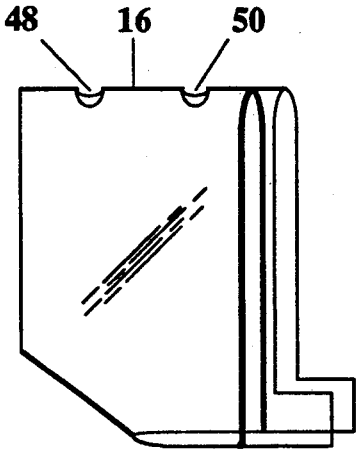
Figure 3D:
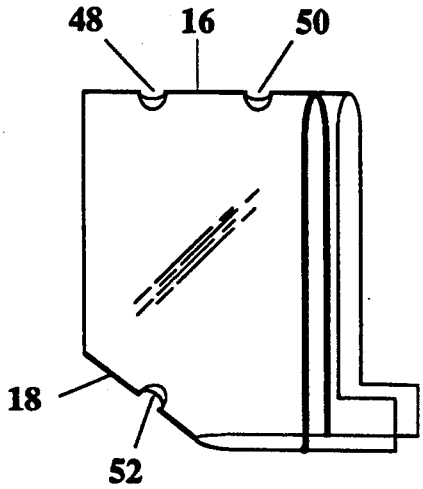

FIGS. 3A, 3B, 3C, and 3D show various alternative arrangements of ventilation holes. In FIG. 3A, additional circular ventilation ducts 44 and 44' have been placed proximally to diagonal lateral edge 18 and bottom edges 22 and 22' to promote further aeration to the bottom portion of the cover. FIG. 3B is similar to the embodiment of the cover depicted in FIG. 1 except that circular ventilation ducts 40, 40', 42, and 42' have been replaced with prolate-shaped ventilation ducts 46 and 46'. In FIG. 3C, two semi-circular die-cuts have been made in the top edge 16 of the cover resulting in two bent-circular (taco-shaped) ventilation ducts 48 and 50. Similar to FIG. 3C, FIG. 3D provides for two bent-circular ventilation ducts 48 and 50 positioned in the top edge 16 with an additional bent-circular duct 52 placed in the diagonal lateral edge 18.

Figure 4A:
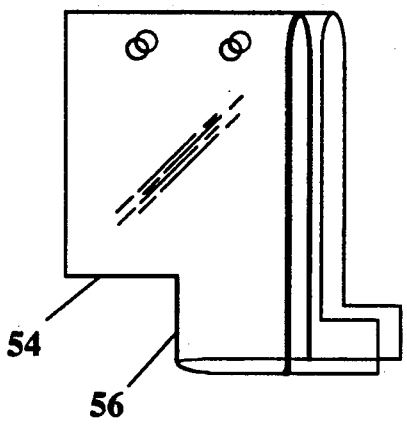
FIGS. 4A, 4B, 4C, and 4D are side perspective views of other preferred embodiments of disposable toothbrush covers which employ different outline geometries but have the same arrangement of ventilation ducts.
Figure 4B:
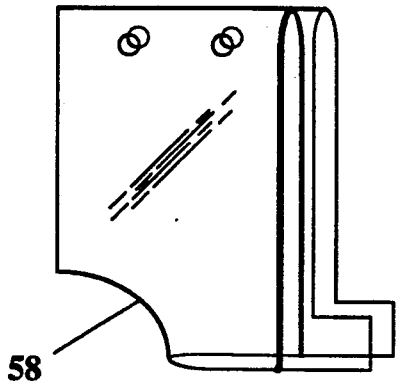
Figure 4C:
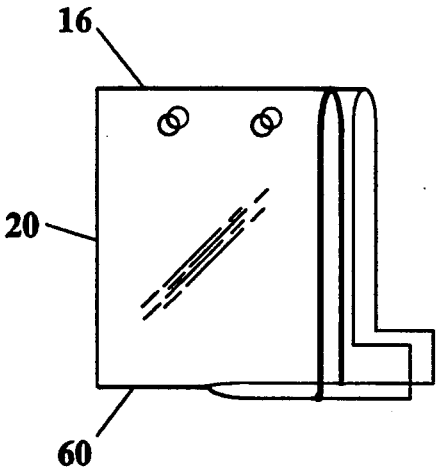
Figure 4D:
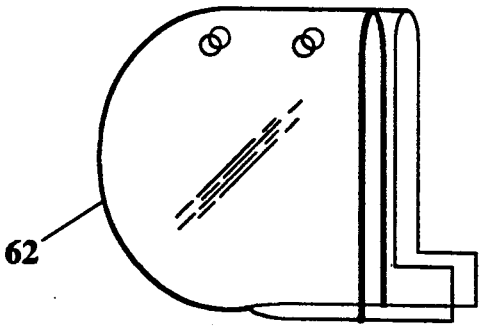

FIGS. 4A, 4B, 4C, and 4D show various alternative top and lateral edge geometries while maintaining four circular ventilation holes 40, 40', 42, and 42' as in FIG. 1. In FIG. 4A, the single diagonal lateral edge 18 of FIG. 1 has been replaced with two perpendicular lateral edges 54 and 56. Similarly, in FIG. 4B, diagonal lateral edge 18 has been replaced with a single concavely curved edge 58. FIG. 4C depicts a rectangular outline geometry with diagonal edge 18 of FIG. 1 being replaced with single edge 60, edge 60 being parallel to top edge 16 and normal to lateral edge 20. FIG. 4D assumes a geometry in which top edge 16 and lateral edges 18 and 20 of FIG. 4C have been replaced with a single semi-circular edge 62.

Figure 5A:
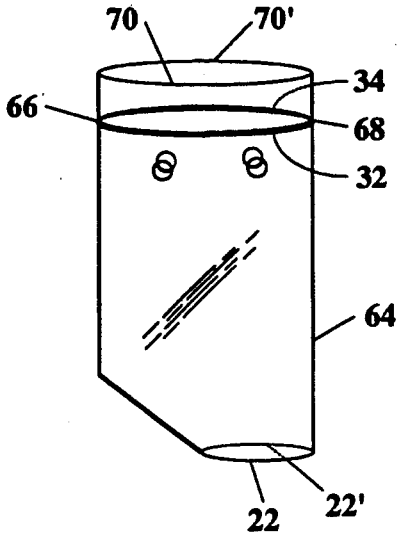
FIGS. 5A, 5B, and 5C are side perspective views of alternative embodiments of disposable toothbrush covers which place a rib-and-groove resealable closure at different positions but have the same outline geometry and the same arrangement of ventilation ducts.
Figure 5B:
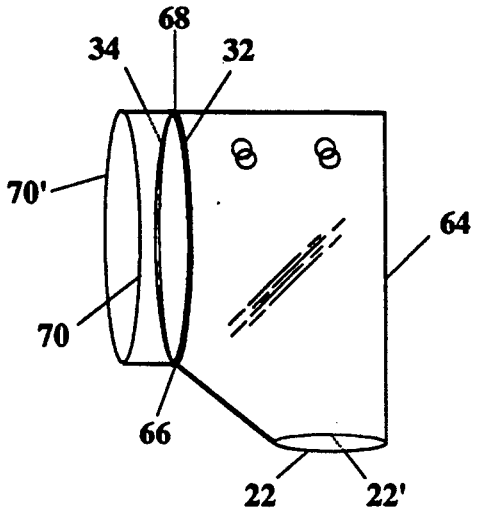
Figure 5C:
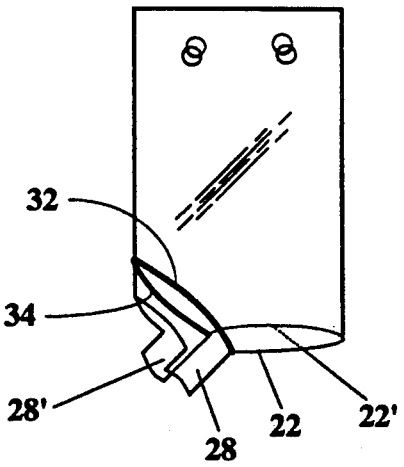

FIGS. 5A, 5B, and 5C show various alternative placements of rib-and-groove closures while maintaining the edge geometry and ventilation duct placement of FIG. 1. In FIG. 5A, rib-and-groove closure 32-34 has been located at the top edge of the cover with lateral edges 26 and 26' of FIG. 1 being permanently sealed to form edge 64. This embodiment requires that the toothbrush be inserted into the cover by directing the handle first through the open rib-and-groove closure, down through the internal aspect of the cover, and out past bottom edges 22 and 22'. Furthermore, no opening tabs are required since rib-and-groove closure profiles 32 and 34 are sealed at both ends 66 and 68, being opened from the middle by grasping and pulling opening webs 70 and 70', as in the case of a conventional resealable zipper-locking bag. FIG. 5B reveals an embodiment in which the rib-and-groove closure has been positioned along lateral edge 20 of FIG. 1 with the opposing lateral edge 64 being permanently sealed. As with the embodiment depicted in FIG. 5A, that in FIG. 5B requires no opening tabs and likewise necessitates the toothbrush be inserted handle first. FIG. 5C depicts the rib-and-groove closure positioned along diagonal lateral edge 18 of FIG. 1, this embodiment utilizing opening tabs 28 and 28' to assist opening the cover near the unsealed bottom edges 22 and 22' similar to the preferred embodiment given in FIG. 1.

Figure 6:
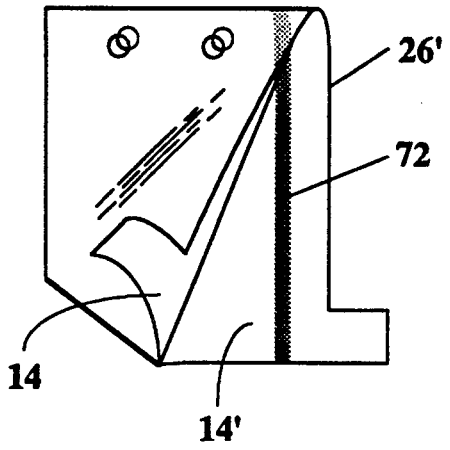
FIG. 6 is a side perspective view of an alternative embodiment of disposable toothbrush cover which is the same in all respects to that given in FIG. 1, except that an adhesive resealable closure has been substituted for a rib-and-groove resealable closure.

FIG. 6 shows an embodiment of the cover similar in all respects to that given in FIG. 1 except that a resealable pressure sensitive adhesive strip closure 72 is used in place of a rib-and-groove closure. Closure is achieved by bringing the adhesive strip into intimate contact with the opposite plastic sheet by the use of sliding finger pressure, similar to that of the rib-and-groove closure. Various embodiments of adhesive closures for plastic bags have been disclosed; U.S. Pat. No. 3,942,713 to Olson et al. (1976) and U.S. Pat. No. 3,420,433 to Bostwick (1969) are representative of these. Adhesive strip 72 is located inward and runs parallel to lateral edge 26' being between 1.25 mm and 5.00 mm in width, more preferably between 2.00 mm and 4.50 mm, and most preferably 3.75 mm. The adhesive material used to fabricate the strip is able to keep the toothbrush cover securely closed but not so aggressive as to tear or permanently deform the plastic sheeting upon opening. Suitable materials for the adhesive closure include but are not limited to acrylic and polyvinyl ether based resins, as well as natural and synthetic rubbers. The adhesive strip is applied to one plastic sheet of the cover, either 14 or 14', the opposite side to which it adheres during closure remaining uncoated. As with the rib-and-groove closure given in FIGS. 5A, 5B, and 5C, the adhesive strip closure may analogously be positioned in differing locations to produce disposable toothbrush covers having differing entry regions.

An advantage of the adhesive strip closure lies in ease of closure: Unlike a rib-and-groove closure, the adhesive strip does not require that the two sides engage in a precise fashion for complete sealing to occur. Additionally, the adhesive closure has a profile that is substantially flat thereby resulting in a potentially increased packing density during packaging.

The advantage of the rib-and-groove closure leading to its use in the preferred embodiment of disposable toothbrush cover is that it is unaffected by the presence of liquid droplets or condensation, such as may be encountered after depositing a wet toothbrush into the cover.

SUMMARY, RAMIFICATIONS, AND SCOPE

Although the description above contains many specificities, these should not be construed as limiting the scope of the invention but as merely providing illustrations of some of the presently preferred embodiments of this invention. For example the toothbrush cover can have other shapes, such as triangular, elliptical, prolate, rhomboid, etc.; the resealable closure may employ other means, such as a fold-over flap or wire tie; the materials employed may be of a laminated nature, such as paper laminated to plastic, multi-film plastic laminates, metallized plastic laminates, or some combination thereof; the ventilation holes may be covered with a semi-permeable barrier sheet material to provide protection from particulates while maintaining breathability; the ventilation holes can have other shapes; the cover may be molded in one piece; etc.

Thus, the scope of the invention should be determined by the appended claims and their legal equivalents, rather than by the examples given.

I claim:

1. A protective cover for the bristle portion of a toothbrush, comprising:

a pouch, shaped substantially to conform to and receive the bristle portion of a toothbrush, made from flat, flexible, waterproof, polyethylene or polypropylene sheets, with a thickness of 0.010 mm to 0.250 mm;

said pouch comprising two opposing side sheets having multiple perimeter portions; said opposing side sheets being joined along corresponding perimeter portions so as to leave two abutting unjoined perimeter portions;

one of said unjoined perimeter portions having resealable closure means thereon for releasably joining a perimeter portion of one of said side sheets to a corresponding perimeter portion of the other of said side sheets;

the other of said unjoined perimeter portions being permanently unjoined and forming an aperture from which the handle of said toothbrush can extend outside the pouch after joinder of said resealable closure means;

one of said joined perimeter portions consisting of a fold line between the opposite side sheets;

said joined perimeter portions other than the fold line being joined by a thermal seal;

said opposing side sheets each having a plurality of aeration holes.

2. The cover of claim 1 wherein said two opposing side sheets each include an integral opening tab.

* * * * *